US010114324B2

(12) United States Patent
Fujitani

(10) Patent No.: US 10,114,324 B2
(45) Date of Patent: Oct. 30, 2018

(54) IMAGE FORMING APPARATUS AND METHOD OF CONTROLLING IMAGE FORMING APPARATUS ALLOWING CORRECTION OF GRADATION LEVEL

(71) Applicant: Sharp Kabushiki Kaisha, Sakai-shi, Osaka (JP)

(72) Inventor: Masaya Fujitani, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 15/241,183

(22) Filed: Aug. 19, 2016

(65) Prior Publication Data

US 2017/0060025 A1 Mar. 2, 2017

(30) Foreign Application Priority Data

Aug. 26, 2015 (JP) ..... 2015-166329

(51) Int. Cl.
*G03G 15/00* (2006.01)

(52) U.S. Cl.
CPC ..... *G03G 15/5041* (2013.01); *G03G 15/5058* (2013.01); *G03G 15/556* (2013.01); *G03G 2215/00569* (2013.01)

(58) Field of Classification Search
CPC ..... G03G 15/5041; G03G 15/556; G03G 15/5058; G03G 2215/00569
See application file for complete search history.

(56) References Cited

U.S. PATENT DOCUMENTS 5,579,090 A * 11/1996 Sasanuma ..... H04N 1/4078 358/521
2016/0246233 A1* 8/2016 Takaishi ..... H04N 1/00082

FOREIGN PATENT DOCUMENTS

JP 2013-148808 A 8/2013

* cited by examiner

*Primary Examiner* — David M Gray
*Assistant Examiner* — Laura Roth
(74) *Attorney, Agent, or Firm* — Keating & Bennett, LLP

(57) ABSTRACT

In an image forming apparatus, a storage portion stores a target adhesion amount of toner to adhere to an image bearing member at each of gradation levels as a target gradation level and a setting value of a control parameter used for control on the image forming portion at the target gradation level. A first control processor makes an adhesion amount sensor measure an actual adhesion amount corresponding to the setting value and thereafter compares a resultant measured value and the target adhesion amount and corrects the setting value if needed in association with at least one of the target gradation levels as a subject. A second control processor makes the image forming portion output a calibration image used for correcting the target adhesion amount using a period when the first control processor performs processing if there arises a need to correct the target adhesion amount associated with the subject.

7 Claims, 8 Drawing Sheets

IMAGE FORMING APPARATUS AND METHOD OF CONTROLLING IMAGE FORMING APPARATUS ALLOWING CORRECTION OF GRADATION LEVEL

CROSS REFERENCE

This Nonprovisional application claims priority under 35 U.S.C. § 119(a) on Patent Application No. 2015-166329 filed in Japan on Aug. 26, 2015, the entire contents of which are hereby incorporated by reference.

BACKGROUND OF THE INVENTION

1. Field of the Invention

This invention relates to an image forming apparatus and a method of controlling the image forming apparatus. More specifically, this invention relates to an image quality adjustment technique employed in an image forming apparatus of an electrophotographic system.

2. Description of Related Art

In an image forming apparatus of an electrophotographic system, to obtain an intended image quality, a setting value of a control parameter is determined in advance in association with each gradation level of each color forming certain color space (CMYK color space, for example). An image quality is likely to change under influence of change in environment (such as temperature or humidity) or aging degradation of the apparatus, for example. Hence, to maintain the intended image quality, the setting value of the control parameter has been required to be corrected by performing calibration at regular intervals. The necessity of calibration has been determined by a user based on an image on a printed matter. If determining that calibration is necessary, the user has been required to make the image forming apparatus output a calibration image for example through operation using a button and to read the output image using a scanner, etc.

For example, an image forming apparatus to be used for producing a large quantity of printed matters is required to perform printing continuously at high speed. This is because such printing reduces a period of time from when printing is started to when the printing is finished. However, determination as to the necessity of calibration should be made by a user. Hence, during the printing, the user has been required to check an image quality at regular intervals. In the case of a conventional image forming apparatus, the user has been required to interrupt printing if there arises a need for calibration. This interruption has been a cause for a delay in the end of production of a large quantity of printed matters.

Then, the following image quality adjustment technique has been suggested (see Japanese published unexamined patent application No. 2013-148808, for example). Specifically, a setting value of a control parameter is determined in association with each gradation level of each color forming certain color space and the adhesion amount (target adhesion amount) of toner to adhere to an image bearing member using the setting value is determined in advance. Then, the adhesion amount of the toner actually adhering to the image bearing member using the setting value is measured using a sensor such as an adhesion amount sensor. A resultant measured value and a corresponding target adhesion amount are compared to correct the setting value if needed. Such an image quality adjustment technique is generally called process control processing and can easily be performed automatically by an image forming apparatus. By performing the process control processing at regular intervals, an intended image quality can be maintained without requiring monitoring by a user. In the below, unless otherwise specified, the term "process control" is distinguished from the term "calibration."

However, even if control is executed so as to achieve a target adhesion amount, with the target adhesion amount being unchanged, the risk of failing to achieve an intended image quality is still caused due to environmental change, for example. Hence, while the process control processing is performed, a need for calibration still arises. If there arises a need for calibration, printing should be interrupted like in the conventional case. Such interruption of printing reduces printing efficiency.

SUMMARY OF THE INVENTION

An image forming apparatus includes: an image forming portion that forms a toner image on an image bearing member; an adhesion amount sensor that measures the amount of toner adhering to the image bearing member; a controller that controls the image forming portion and the adhesion amount sensor; and a storage portion. In association with gradation levels of each color forming certain color space, the storage portion stores a target adhesion amount of toner to adhere to the image bearing member at each of the gradation levels as a target gradation level and a setting value of a control parameter used for control on the image forming portion at the target gradation level. The controller includes a first control processor and a second control processor. The first control processor makes the adhesion amount sensor measure an actual adhesion amount corresponding to the setting value of the control parameter and thereafter compares a resultant measured value and the target adhesion amount and corrects the setting value if needed, in association with at least one of the target gradation levels as a subject. This processing by the first control processor is what is called process control processing. The second control processor makes the image forming portion output a calibration image used for correcting the target adhesion amount using a period when the first control processor performs the processing, if there arises a need to correct the target adhesion amount associated with the subject target gradation level.

DETAILED DESCRIPTION OF THE EMBODIMENTS

1. Structure of Image Forming Apparatus

Figure 1:
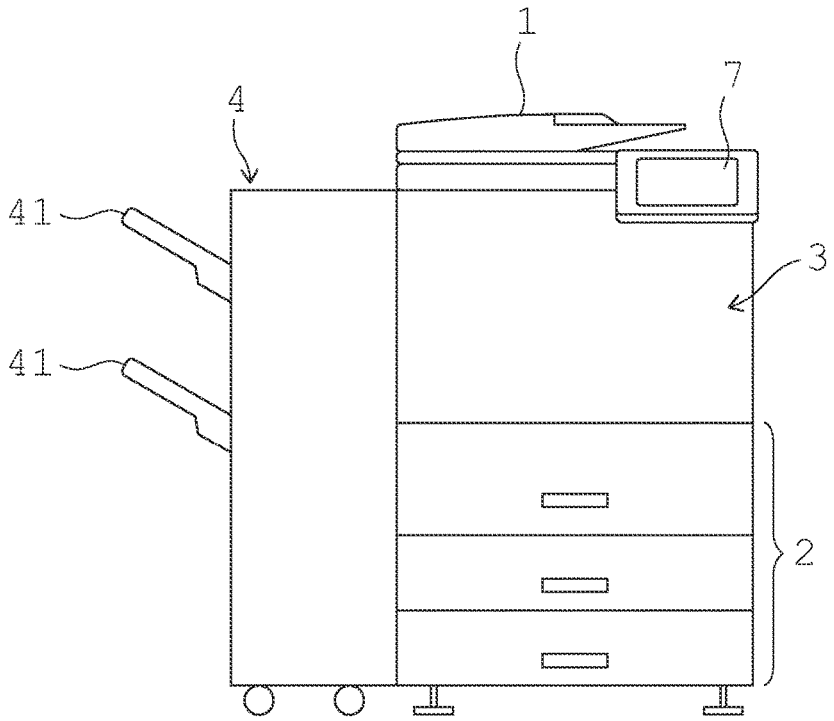
FIG. 1 is a front view of an image forming apparatus according to an embodiment of this invention.
Figure 2:
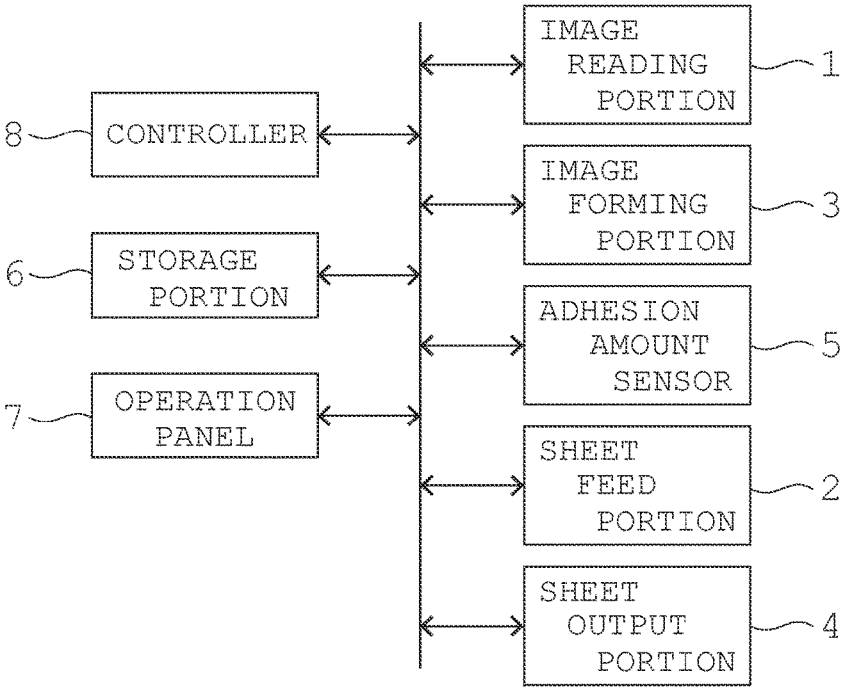
FIG. 2 is a block diagram of the image forming apparatus.

As shown in FIGS. 1 and 2, an image forming apparatus includes an image reading portion 1, a sheet feed portion 2, an image forming portion 3, a sheet output portion 4, an adhesion amount sensor 5, a storage portion 6, an operation panel 7, and a controller 8. The image reading portion 1 generates image data by optically reading an image on a document loaded on a document platen. The image reading portion 1 can read an image in parallel with formation of an image by the image forming portion 3 described later. The image reading portion 1 may have an automatic document feeding mechanism.

The sheet feed portion 2 stores sheets and feeds them one by one to the image forming portion 3. These sheets are not limited to sheets made from paper such as plain paper or photographic paper but include sheets made from a resin material such as OHP films and sheets made from various other materials. The sheet feed portion 2 is not limited to a sheet feed cassette but it may include a manual feed tray.

The image forming portion 3 prints an image on a sheet fed from the sheet feed portion 2 by performing image forming processing of an electrophotographic system based on the image data. The image data is not limited to data generated by the image reading portion 1 but it may include image data obtained from an external information processing apparatus through a network, for example.

Figure 3:
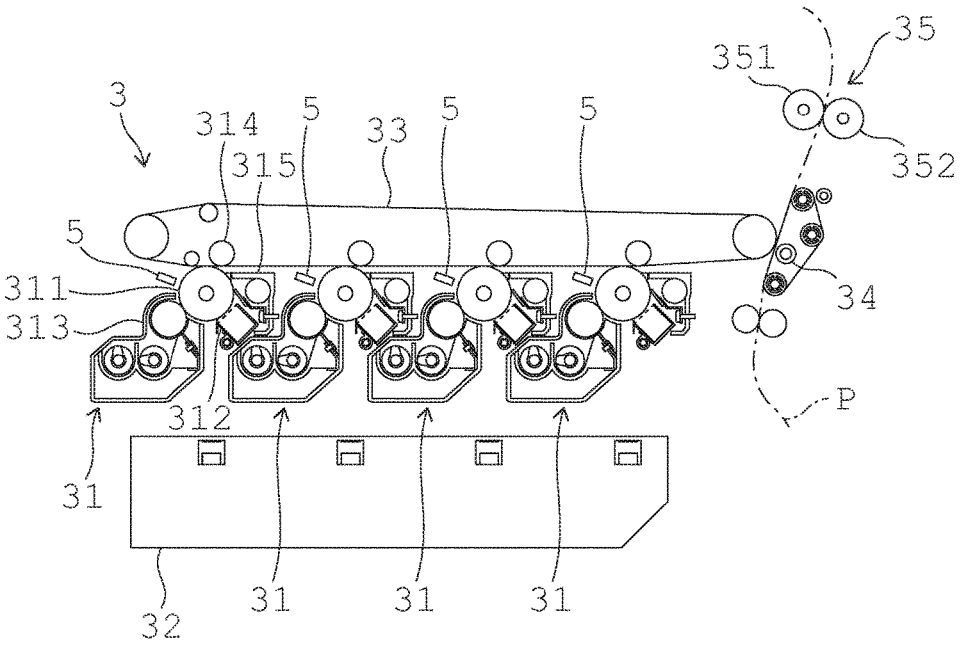
FIG. 3 is a conceptual view of an image forming portion in the image forming apparatus.

As shown in FIG. 3, the image forming portion 3 includes four main processors 31, an exposure portion 32, an intermediate transfer belt 33, a secondary transfer roller 34, and a fixing portion 35. Color space intended to be employed in the image forming apparatus of this embodiment is CMYK space. Thus, the four main processors 31 are to generate toner images of the four colors (cyan, magenta, yellow, and black) forming the CMYK space. The number of the main processors 31 to be installed may be changed according to color space to be employed. For example, an image forming apparatus intended for monochrome printing includes one main processor 31.

Each of the main processors 31 includes a photoreceptor drum 311, a charging portion 312, a developing portion 313, a primary transfer roller 314, and a cleaning portion 315. The photoreceptor drum 311 is an electrostatic latent image bearing member. The charging portion 312 charges the photoreceptor drum 311 in such a manner that the circumferential surface of the photoreceptor drum 311 is placed at a given potential. In response to irradiation with laser from the exposure portion 32, an electrostatic latent image responsive to the image data is formed on the circumferential surface of the charged photoreceptor drum 311.

The developing portion 313 applies a bias (developing bias) to a developing roller, thereby moving toner (developer) adhering to the circumferential surface of the developing roller to the circumferential surface of the photoreceptor drum 311. In this way, the electrostatic latent image is developed into a toner image. In response to the rotation of the photoreceptor drum 311, the toner image is carried to a position (primary transfer position) where the toner image is to be transferred to the intermediate transfer belt 33 (primary transfer).

The primary transfer roller 314 transfers the toner image born on the photoreceptor drum 311 onto the intermediate transfer belt 33 passing between the primary transfer roller 314 and the photoreceptor drum 311. More specifically, in response to application of a bias to the primary transfer roller 314, the primary transfer roller 314 generates electrostatic force on the toner forming the toner image and moves the toner image to the intermediate transfer belt 33 using the electrostatic force.

Toner images of the four colors generated by the four main processors 31 based on the image data are transferred to the same region on the intermediate transfer belt 33 so as not to shift from each other. In this way, the toner images of the four colors overlap each other to form a full-color toner image on the intermediate transfer belt 33. In response to the rotation of the intermediate transfer belt 33, the full-color toner image is carried to a position where the full-color toner image is to be transferred to a sheet (secondary transfer). In FIG. 3, the sheet is indicated by a sign P.

The cleaning portion 315 removes toner and other subjects (including dirt) remaining adhering to the circumferential surface of the photoreceptor drum 311 after the primary transfer. In this way, preparation for next image forming processing is made.

The secondary transfer roller 34 transfers the full-color toner image born on the intermediate transfer belt 33 onto a sheet fed from the sheet feed portion 2. More specifically, in response to application of a bias to the secondary transfer roller 34, the secondary transfer roller 34 generates electrostatic force on the toner forming the toner image and moves the toner image to the sheet using the electrostatic force.

The fixing portion 35 includes a heating roller 351 and a pressure roller 352 contacting the heating roller 351 under pressure. The sheet including the transferred toner image is passed through between the heating roller 351 and the pressure roller 352 to apply appropriate heat and appropriate pressure to the toner image. In this way, the toner image is fixed on the sheet. Then, the sheet is carried to the sheet output portion 4.

The sheet output portion 4 includes a plurality of sheet output trays 41. In response to a command from the controller 8, the sheet output portion 4 outputs the sheet on which the toner image has been fixed to any of the sheet output trays 41 selectively.

The adhesion amount sensor 5 includes four adhesion amount sensors 5 provided in corresponding relationship with the photoreceptor drums 311 of the four main processors 31. Each of the adhesion amount sensors 5 measures the amount of toner adhering to a corresponding one of the photoreceptor drums 311. More specifically, each of the adhesion amount sensors 5 is arranged to face a toner image formed on a corresponding one of the photoreceptor drums 311 in the course of carriage of this toner image to the primary transfer position.

The storage portion 6 stores image data used for printing and a setting value of a control parameter (such as a developing bias) used for control on each portion (such as the image forming portion 3) of the image forming apparatus. The controller 8 controls each portion of the image forming apparatus based on the image data and the setting value stored in the storage portion 6.

The operation panel 7 is a touch panel, for example, and functions as a user interface. Specifically, the operation panel 7 has a function as an input portion to accept a command relating to operation input from a user, and a function as a display portion to present information such as an operating condition to the user.

Various control processors such as a central processing unit (CPU) and a microcomputer are applicable as the controller 8. Processing by the controller 8 may be performed by making the image forming apparatus execute a series of programs corresponding to this processing. Such programs may be stored in a storage medium (such as a flash memory) in a state of being readable by the storage medium, or may be stored in the storage portion 6.

2. Control on Image Forming Apparatus

Figure 4:
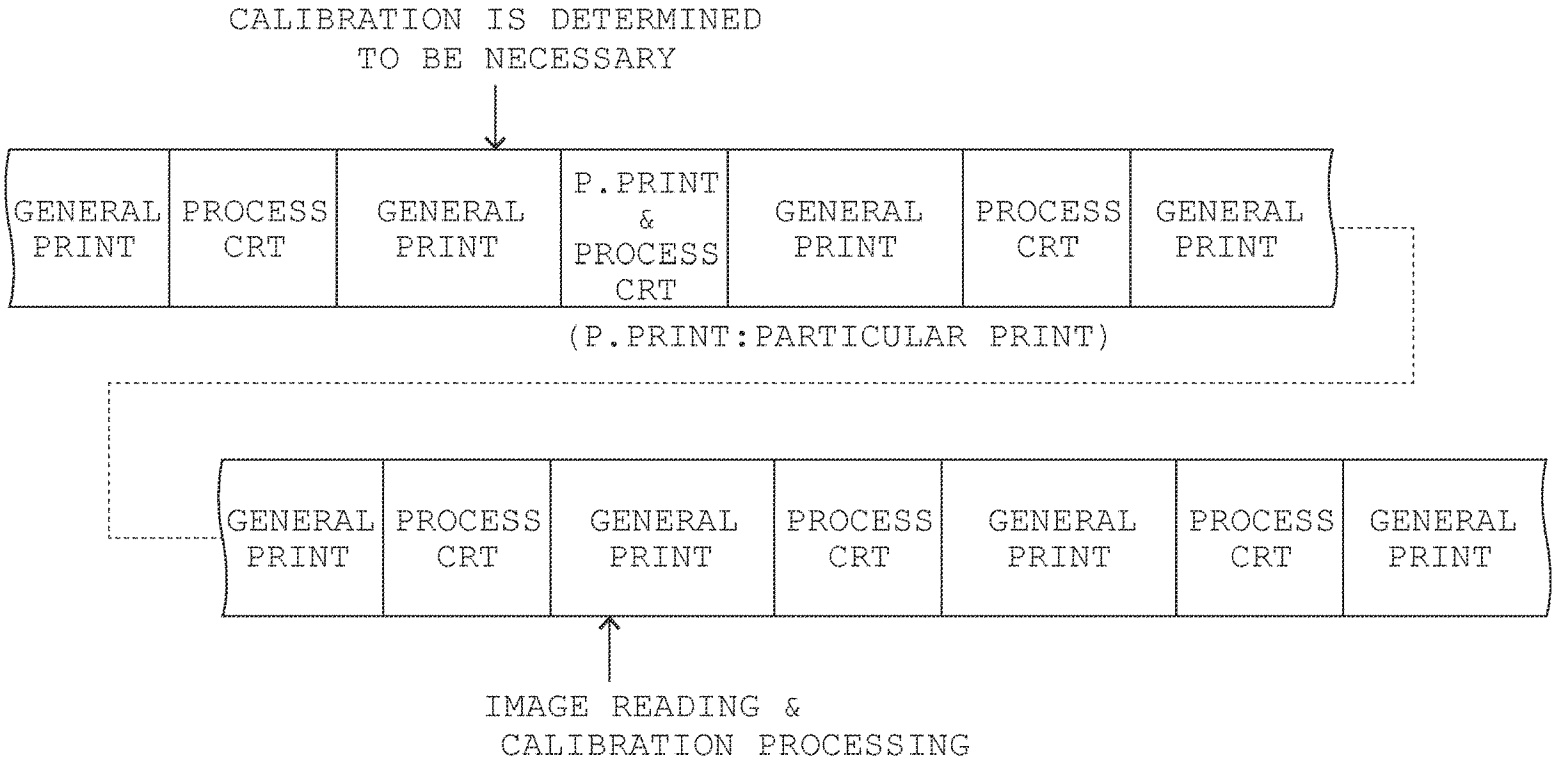
FIG. 4 is a timing diagram showing a period when general printing is performed and periods when various types of processing for image quality adjustment are performed.
Figure 5:
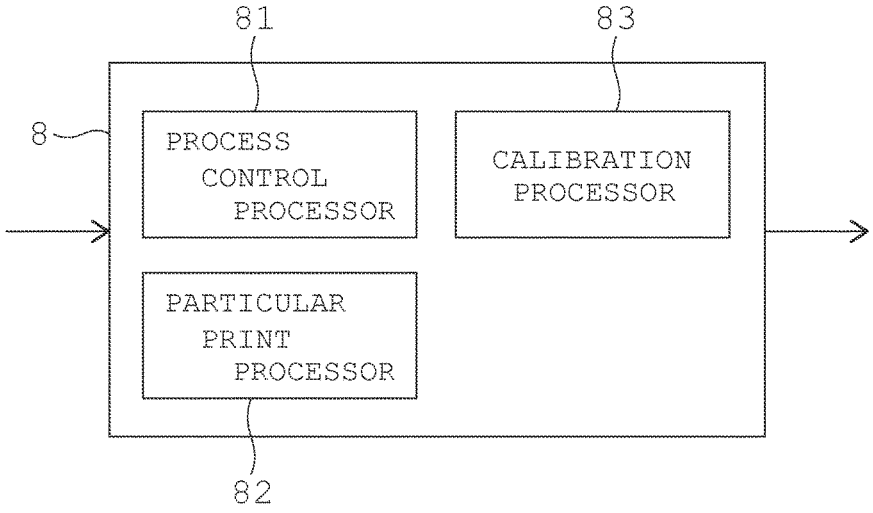
FIG. 5 is a block diagram of a controller in the image forming apparatus.

Control executed by the controller 8 in the image forming apparatus is described in detail next. The controller 8 performs image quality adjustment processing so as to obtain an intended image quality of a printed matter in addition to general print processing. As shown in FIG. 4, in this embodiment, the image quality adjustment processing to be performed includes process control processing, particular print processing, and calibration processing. More specifically, as shown in FIG. 5, the controller 8 includes a process control processor 81, a particular print processor 82, and a calibration processor 83. These processors 81 to 83 correspond to a first control processor, a second control processor, and a third control processor respectively recited in the claims. In FIGS. 4 and 5, the process control processing is abbreviated as "PROCESS CRT PROCESSING."

To permit image quality adjustment by the controller 8, in association with gradation levels of each of the four colors forming CMYK space (cyan, magenta, yellow, and black), the storage portion 6 stores a target adhesion amount of toner to adhere to the photoreceptor drum 311 at each of the gradation levels as a target gradation level and a setting value of a control parameter (such as a developing bias) used for control at the target gradation level.

In order for an actual adhesion amount to agree with a target adhesion amount in association with each target gradation level of each color, the process control processor 81 corrects a setting value of a corresponding control parameter. In order to achieve an intended gradation level in an image on a printed matter, the calibration processor 83 corrects the target adhesion amount corresponding to each target gradation level. During manufacture or shipment from a factory of the image forming apparatus, predetermined values are stored as the target adhesion amount and the setting value into the storage portion 6. Then, these values stored in the storage portion 6 are corrected through the process control processing and the calibration processing.

The storage portion 6 further stores image data for process control and image data for calibration. The image data for process control is about a plurality of patch images drawn to represent the respective gradation levels of the four colors separately and to represent the gradation levels of each of the four colors in stages. If the density of a color is expressed in 256 gradation levels, for each color drawn are patch images whose densities are changed in stages at an interval of 16 gradation levels, for example. Likewise, the image data for calibration is about a plurality of patch images drawn to represent the respective gradation levels of the four colors separately and to represent the gradation levels of each of the four colors in stages. These two pieces of image data may be the same image data or may be different pieces of image data about different numbers of drawn patch images (specifically, one image data has patch images whose densities are changed at an interval different from an interval for the other image data). Alternatively, one piece of image data may be used in common as these two pieces of image data.

2-1. Process Control Processing

The process control processing is performed based on determination by the controller 8. Specifically, the controller 8 determines whether or not the process control processing should be performed. If determining that the process control processing should be performed, the controller 8 makes the process control processor 81 perform the process control processing. As an example, the controller 8 counts the number of sheets printed by general printing and determines whether or not the counted number has reached a given number of sheets. If determining that the counted number agrees with the given number, the controller 8 makes the process control processor 81 perform the process control processing. As shown in FIG. 4, the process control processing is performed repeatedly at a higher frequency than the calibration processing.

Figure 6:
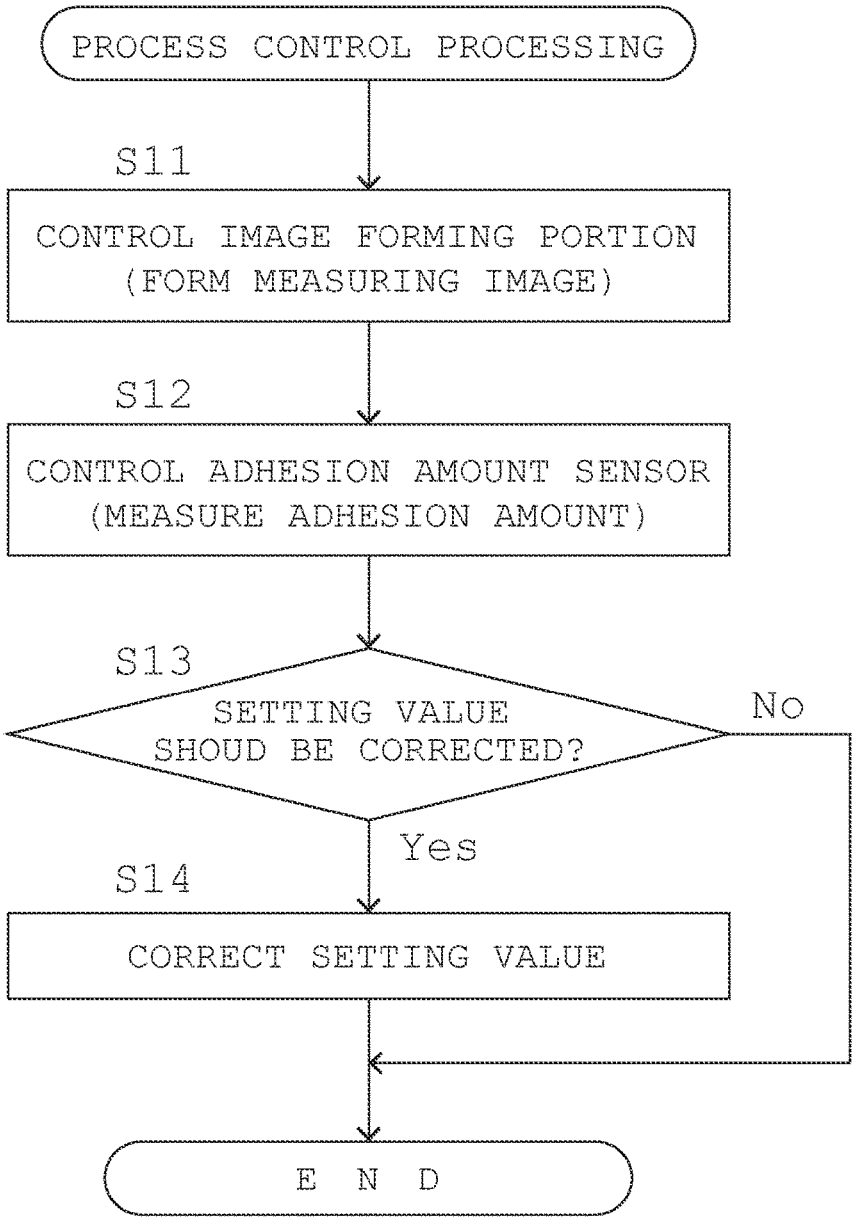
FIG. 6 is a flowchart of process control processing.

FIG. 6 is a flowchart of the process control processing. In the process control processing, the process control processor 81 makes the image forming portion 3 form a toner image based on the image data for process control (step S11). As a result of this step, the image forming portion 3 forms a patch image (measuring image) representing the density of each color on the photoreceptor drum 311 corresponding to this color using a setting value of a control parameter stored in the storage portion 6. More specifically, the image forming portion 3 forms each patch image using the setting value of the control parameter corresponding to a gradation level (target gradation level) intended to be represented by this patch image.

Next, with the patch image (measuring image) formed on each photoreceptor drum 311 being taken as a subject of measurement, the process control processor 81 makes the adhesion amount sensor 5 measure an actual adhesion amount about each patch image (step S12). Then, the process control processor 81 compares the resultant measured value (actual adhesion amount) and a target adhesion amount in association with each color or each gradation level of each color, and corrects the setting value of the control parameter if needed (steps S13 and S14). In this way, control is executed in such a manner that the actual adhesion amount agrees with the target adhesion amount in association with each target gradation level of each color. Specifically, an image quality is adjusted by performing the process control processing. The patch image formed on the corresponding photoreceptor drum 311 is generally removed from this photoreceptor drum 311 after the measurement (step S12) of an adhesion amount.

2-2. Particular Print Processing

A calibration image is printed on a sheet by the particular print processing. The particular print processing is performed as follows based on determination by the controller 8. Specifically, the controller 8 determines whether or not calibration is necessary. If determining that calibration is necessary, the controller 8 makes the particular print processor 82 perform the particular print processing using a period when the process control processing is performed (see FIGS. 4 and 5). The controller 8 makes determination as to the necessity of calibration. This differs from the conventional technique according to which a user is to make the same determination. The calibration image is printed using a period when the process control processing is performed. This differs from the conventional technique according to which a calibration image is printed in response to a command given through user's operation using a button, for example.

Determination as to the necessity of calibration is made as follows. As an example, the controller 8 makes such determination based on the number of sheets printed by general printing. More specifically, the controller 8 counts the number of sheets printed by the general printing and determines whether or not the counted number has reached a given number of sheets. If determining that the counted number has reached the given number, the controller 8 determines that calibration is necessary. As another example, the controller 8 makes determination as to the necessity of calibration based on the measured value (actual adhesion amount) measured during implementation of the process control processing and the target adhesion amount. More specifically, the controller 8 obtains a difference between the measured value and the target adhesion amount and determines whether or not the absolute value of the difference is a given value or more. If determining that the absolute value is the given value or more, the controller 8 determines that calibration is necessary.

The particular print processor 82 makes the image forming portion 3 form a toner image based on the image data for calibration. As a result of this step, the image forming portion 3 forms a patch image (calibration image) representing the density of each color on the photoreceptor drum 311 corresponding to this color using a setting value of a control parameter stored in the storage portion 6. More specifically, the image forming portion 3 forms each patch image using the setting value of the control parameter corresponding to a gradation level (target gradation level) intended to be represented by this patch image. The setting value used in this step is not a setting value corrected by the process control processing performed in the same period but a setting value before being corrected.

Patch images formed on the four photoreceptor drums 311 are all subjected to primary transfer, secondary transfer, and fixation to be printed onto one sheet. This sheet is output as a printed matter of the calibration image to the sheet output tray 41. At this time, the particular print processor 82 selects one from the plurality of sheet output trays 41 different from a sheet output tray 41 to which a general printed matter is to be output. Then, the particular print processor 82 outputs the printed matter of the calibration image to the selected sheet output tray 41. In this way, the printed matter of the calibration image is prevented from being mixed with the general printed matter. As a result of the following control, the printed matter of the calibration image can be output to the sheet output tray 41 to which a general printed matter is to be output without being mixed with this general printed matter. Specifically, the particular print processor 82 shifts an output position for the printed matter of the calibration image from an output position for other printed matters.

In addition to printing of the calibration image, the particular print processor 82 stores the measured value (actual adhesion amount) in association with a corresponding target gradation level of each color into the storage portion 6. This measured value is a value measured in the particular print processing performed in the same period as the printing of the calibration image, and is retained in the storage portion 6 at least for a period before it is used in the calibration processing.

2-3. Calibration Processing

The calibration processing is performed when the calibration image is read by the image reading portion 1. The image reading portion 1 reads the calibration image through user's operation as follows. First, the user recognizes the necessity of calibration by knowing that the printed matter of the calibration image is output to the sheet output tray 41. Then, for execution of calibration, the user makes the image reading portion 1 read the calibration image. The image reading portion 1 can read the image in parallel with image formation by the image forming portion 3. Thus, even after the user starts calibration, general printing being performed is not interrupted.

Figure 7:
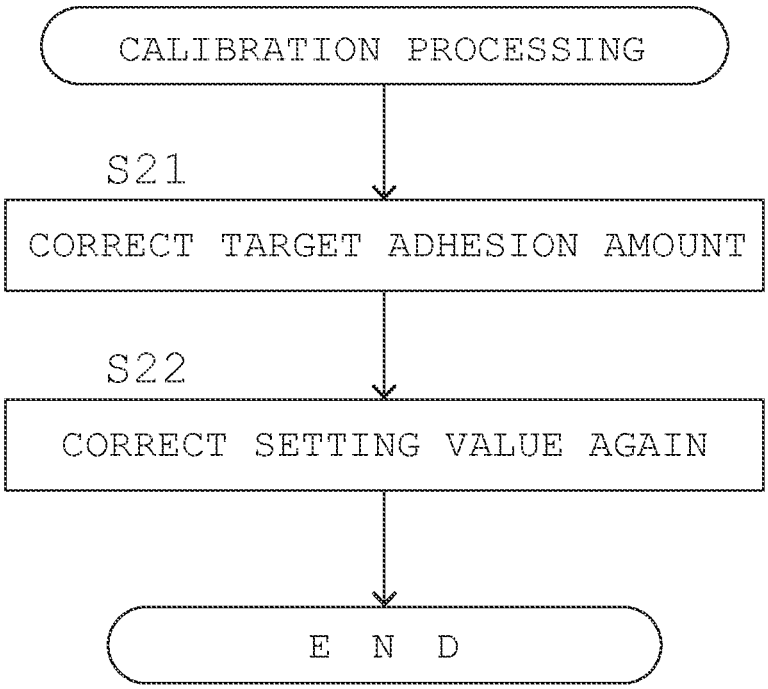
FIG. 7 is a flowchart of calibration processing.

FIG. 7 is a flowchart of the calibration processing. Based on a gradation level obtained from the calibration image, the calibration processor 83 corrects the target adhesion amount and stores the corrected target adhesion amount as a new target adhesion amount into the storage portion 6 (step S21). More specifically, the calibration processor 83 compares the gradation level obtained from the calibration image and the corresponding target gradation level. Further, the calibration processor 83 compares the measured value of the adhesion amount (actual adhesion amount) stored into the storage portion 6 during implementation of the particular print processing and the target adhesion amount. Then, the calibration processor 83 corrects the target adhesion amount based on these comparisons to correct a gradation level deviation of each color.

Next, the calibration processor 83 corrects the setting value of the control parameter based on the corrected target adhesion amount (step S22). More specifically, based on the corrected target adhesion amount and the adhesion amount measured by the process control processing performed last before the calibration image is read, the calibration processor 83 again corrects the setting value of the control parameter having been used for formation of the patch image by this process control processing. Then, the calibration processor 83 stores the re-corrected setting value into the storage portion 6.

In the image forming apparatus of this embodiment, if there arises a need for calibration (correction of a target adhesion amount) during the course of production of a large quantity of printed matters, the particular print processing is performed (a calibration image is output) using a period when the process control processing is planned to be performed. Thus, the production of a large quantity of printed matters is not interrupted. Further, a calibration image is read and the calibration processing is performed without interrupting general printing. Thus, even if there arises a need for calibration, the image forming apparatus of this embodiment does not interrupt printing, thereby enhancing printing efficiency.

3. Other Embodiments 3-1. Second Embodiment

As described above, the controller 8 determines whether or not calibration is necessary. If determining that calibration is necessary, the controller 8 makes the particular print processor 82 perform the particular print processing using a period when the process control processing is performed. In the aforementioned embodiment, the particular print processor 82 forms and prints a calibration image separately from a measuring image having been used in the process control processing. However, this is not the only control relating to the particular print processing.

Figure 8:
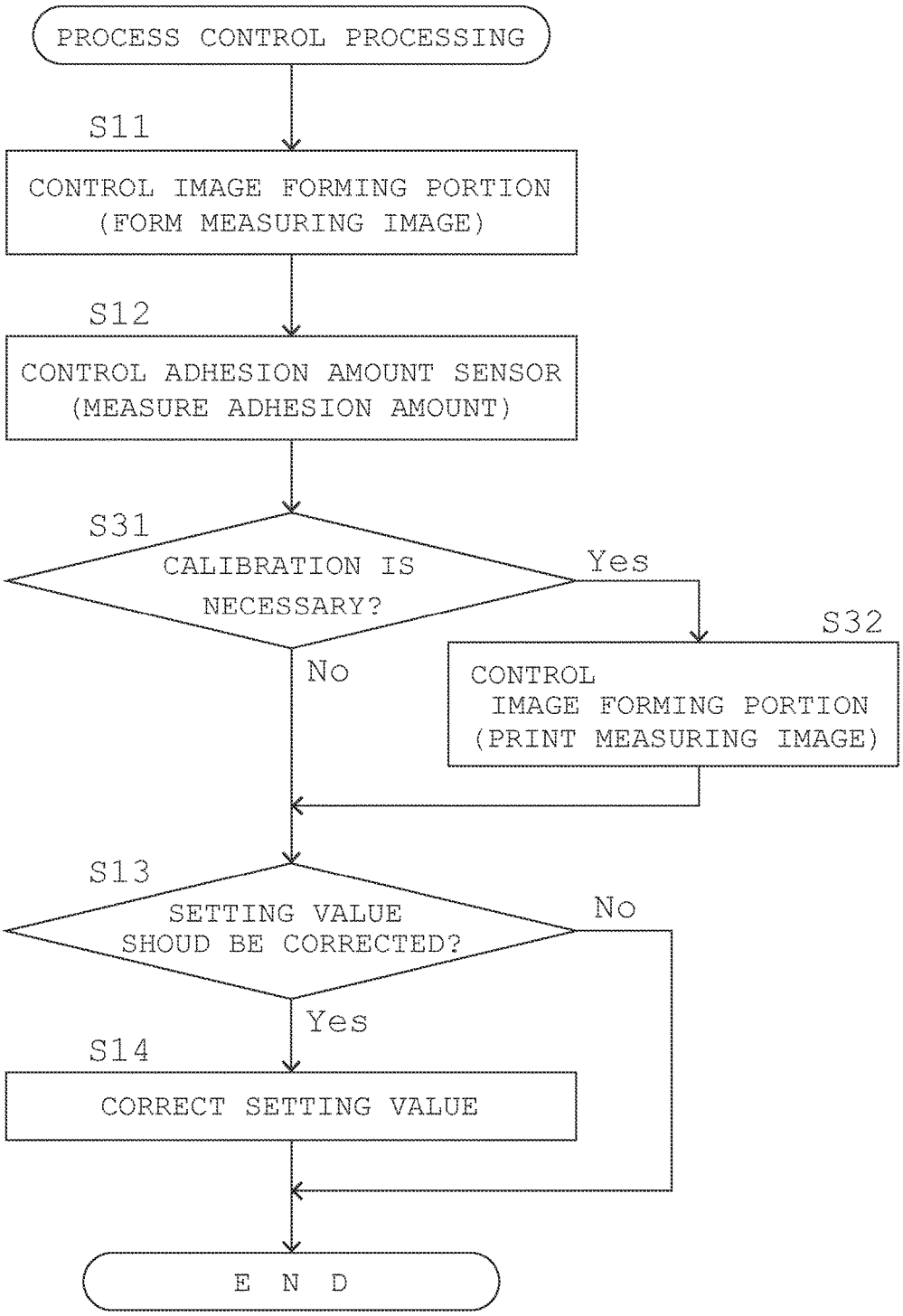
FIG. 8 is a flowchart showing a modification of the process control processing.

As shown in FIG. 8, the controller 8 may determine whether or not calibration is necessary during the course of implementation of the process control processing (step S31). If determining that calibration is necessary, the particular print processor 82 may make the image forming portion 3 print a measuring image having been used in the process control processing as a calibration image (step S32). This enhances printing efficiency further.

Determination as to the necessity of calibration may be made before implementation of the process control processing is started. In this case, if determining that calibration is necessary, the controller 8 sets a flag. The controller 8 determines in step S31 whether or not such a flag is set. Like in the aforementioned embodiment, in step S32, a calibration image may be formed and printed separately from the measuring image having been used in the process control processing.

3-2. Third Embodiment

In the aforementioned embodiments, the controller 8 (calibration processor 83) performs the calibration processing to automatically correct a target adhesion amount. However, this is not the only way of calibration.

For example, a result of reading of a calibration image may be displayed on the operation panel 7 and a user may correct a target adhesion amount manually based on the displayed result. Alternatively, a user may correct a target adhesion amount manually by checking a printed calibration image visually without making the image reading portion 1 read a calibration image.

3-3. Other Examples

A color multifunction machine is employed as an example of the aforementioned image forming apparatus. However, a range of application of the structure of each portion and control on each portion of the image forming apparatus is not limited to a color multifunction machine but can be extended to various types of image forming apparatuses such as a color copier and a color printer. Additionally, the aforementioned image forming apparatus is not limited to an image forming apparatus to form color images but can be modified as an image forming apparatus to form monochrome images.

In the aforementioned embodiments, with a patch image formed on the photoreceptor drum 311 being taken as a subject of measurement, an adhesion amount is measured using the adhesion amount sensor 5. However, a patch image on the photoreceptor drum 311 is not the only subject of measurement. For example, with a patch image transferred on the intermediate transfer belt 33 being taken as a subject of measurement, an adhesion amount may be measured using the adhesion amount sensor 5. In this case, the intermediate transfer belt 33 corresponds to an image bearing member recited in the appended claims.

It should be noted that the foregoing description of the embodiments is in all aspects illustrative and not restrictive. The scope of this invention is defined by the appended claims rather than by the embodiments described above. All changes that fall within a meaning and a range equivalent to the scope of the claims are therefore intended to be embraced by the claims.

What is claimed is:

1. An image forming apparatus comprising:

an image forming portion that forms a toner image on an image bearing member;

an adhesion amount sensor that measures the amount of toner adhering to the image bearing member;

a controller that controls the image forming portion and the adhesion amount sensor; and a storage portion, wherein in association with gradation levels of each color forming certain color space, the storage portion stores a target adhesion amount of toner to adhere to the image bearing member at each of the gradation levels as a target gradation level and a setting value of a control parameter used for control on the image forming portion at the target gradation level, and the controller includes:

a first control processor that performs processing, the processing includes making the adhesion amount sensor measure an actual adhesion amount corresponding to the setting value and thereafter comparing a resultant measured value and the target adhesion amount and correcting the setting value if needed, in association with at least one of the target gradation levels as a subject; and a second control processor that determines whether or not correction of the target adhesion amount associated with the subject target gradation level is necessary, and if the second control processor determines that the correction is necessary, the second control processor makes the image forming portion output a calibration image, which is used for correcting the target adhesion amount, and the calibration image is output while the first control processor performs the processing.

2. The image forming apparatus according to claim 1, further comprising an image reading portion that reads an image on a document, wherein the controller further includes a third control processor that corrects the target adhesion amount based on a gradation level obtained from the calibration image if the image reading portion reads the calibration image.

3. The image forming apparatus according to claim 2, wherein based on the adhesion amount measured in the processing performed last by the first control processor before the calibration image is read and the target adhesion amount corrected, the third control processor corrects the setting value again.

4. The image forming apparatus according to claim 1, wherein the first control processor makes the image forming portion form a measuring image on the image bearing member to be used for measurement of the actual adhesion amount and thereafter makes the adhesion amount sensor measure the actual adhesion amount on the measuring image, and the second control processor makes the image forming portion output the measuring image as the calibration image.

5. The image forming apparatus according to claim 1, wherein if an absolute value of a difference between the resultant measured value and the target adhesion amount is a given value or more, the second control processor determines that the correction of the target adhesion amount is necessary.

6. The image forming apparatus according to claim 1, wherein if the second control processor determines that the correction of the target adhesion amount is necessary and if the determination is made during general printing, the second control processor makes the image forming portion output the calibration image while the first control processor performs the processing after the determination is made.

7. A method of controlling an image forming apparatus, the image forming apparatus comprising: an image forming portion that forms a toner image on an image bearing member; an adhesion amount sensor that measures the amount of toner adhering to the image bearing member; a controller that controls the image forming portion and the adhesion amount sensor; and a storage portion, in association with gradation levels of each color forming certain color space, the storage portion storing a target adhesion amount of toner to adhere to the image bearing member at each of the gradation levels as a target gradation level and a setting value of a control parameter used for control on the image forming portion at the target gradation level, the method comprising the steps of:

(i) making the adhesion amount sensor measure an actual adhesion amount corresponding to the setting value and thereafter comparing a resultant measured value and the target adhesion amount and correcting the setting value if needed, in association with at least one of the target gradation levels as a subject; and (ii) determining whether or not correction of the target adhesion amount associated with the subject target gradation level is necessary, and if the correction is determined to be necessary, making the image forming portion output a calibration image, which is used for correcting the target adhesion amount, and the calibration image is output while the step (i) is performed.

* * * * *